United States Patent [19]

Simm et al.

[11] 4,389,251

[45] Jun. 21, 1983

[54] POWDER MIXTURE FOR THERMAL SPRAYING

[75] Inventors: Wolfgang Simm, Lausanne; Hans-Theo Steine, Chavannes; Daniel Audemars, Echandens, all of Switzerland

[73] Assignee: Castolin S.A., Saint-Sulpice, Switzerland

[21] Appl. No.: 225,047

[22] Filed: Jan. 14, 1981

[30] Foreign Application Priority Data

Jan. 17, 1980 [CH] Switzerland ..... 386/80

[51] Int. Cl.[3] ..... B22F 1/00

[52] U.S. Cl. ..... 75/255; 427/34; 427/423; 428/937

[58] Field of Search ..... 427/423, 34; 75/251–255, 0.5 B, 0.5 BA, 0.5 BB, 0.5 BC; 428/937

[56] References Cited

U.S. PATENT DOCUMENTS

| | | | |
|---|---|---|---|
| 3,230,097 | 1/1966 | Fischer | 75/255 |
| 3,254,970 | 6/1966 | Dittrich et al. | 75/251 |
| 3,410,732 | 11/1968 | Smith | 75/255 |
| 3,455,019 | 7/1969 | Quaas | 75/255 |
| 3,617,358 | 11/1971 | Dittrich | 427/423 |
| 3,819,384 | 6/1974 | Ingham, Jr. et al. | 75/255 |
| 4,019,875 | 4/1977 | Dittrich et al. | 75/255 |
| 4,101,319 | 7/1978 | Beyer et al. | 75/255 |
| 4,190,443 | 2/1980 | Patel | 75/255 |

FOREIGN PATENT DOCUMENTS

| | | | |
|---|---|---|---|
| 2841552 | 3/1980 | Fed. Rep. of Germany | 75/251 |

OTHER PUBLICATIONS

Lyman, T.; *Metals Handbook 1948 Edition*, Am. Soc. for Metals, p. 95, (1948).

Hall, F.; "Flame Sprayed Coatings", *Product Engineering*, pp. 59–64, Dec. 6, 1965.

*Primary Examiner*—Michael L. Lewis

*Attorney, Agent, or Firm*—Hopgood, Calimafde, Kalil, Blaustein & Judlowe

[57] ABSTRACT

A powder mixture for thermal spraying is disclosed which comprises at least two powders of alloys with a different hardness in the range from 200 to 650 Hv and/or a different static coefficient of friction in the range from 0.01 to 0.3 μs.

The protective layers obtained by thermal spraying of the mixture have a heterogeneous, lamellar structure with low internal tensions even at substantial thickness, they have high resistance to frictional wear and very good frictional properties.

36 Claims, No Drawings

POWDER MIXTURE FOR THERMAL SPRAYING

The invention relates to a spraying powder consisting of a mixture of at least two different alloys, for producing a heterogeneous layer on a substrate by a usual process of thermal spraying.

Known layers resistant to frictional wear and consisting of relatively hard alloys present strong inherent tensions, which introduce a high danger of cracking. This danger exists, both at the time of forming the layer on the substrate part and during operation of the part when temperature loading occurs at the layer. Furthermore, known layers having high wear resistance, such as layers including carbides or hard oxides, show poor frictional properties, as a result of which their use on parts subjected to friction becomes problematical or impossible, because of the resulting scratching effect.

The main object of the invention is to provide a spraying powder allowing to produce, by thermal spraying, a protective layer on a substrate, which layer has only low inherent tensions and a high resistance to frictional wear. It is a further object of the invention to provide a spraying powder allowing to produce such a layer having in addition very good frictional properties and allowing to substantially increase the life of the protected substrate part in operation.

These and other objects are achieved, according to the invention, by a spraying powder comprising a mechanical mixture of alloy powders of at least two different alloys being selected among a nickel and/or a cobalt and/or an iron alloy and having a different hardness within the range from 200 to 650 Hv and/or, when in cast, sprayed or similar form, a different static coefficient of friction in the range from 0.01 to 0.3 $\mu_S$. Preferably, at least one of the alloys of said mixture is selected among alloys undergoing a modification in structure during the spraying operation.

In preferred embodiments of the invention, the hardness of a first alloy of the said mixture is within the range of 200 to 450 Hv and preferably of 200 to 380 Hv, and the hardness of a second alloy of the said mixture is within the range of 350 to 650 Hv and preferably of 350 to 500 Hv, the said difference in hardness being of at least 30 Hv. Hv designates, as usually, the hardness after Vickers (corresponding to the Diamond Pyramid Hardness designated DPH). The static coefficient of friction herein referred to, is defined for an alloy in cast, sprayed or similar form.

The layers obtained with the powder according to the invention can be used with great advantage in an installation for the manufacture of paper, for example, on a paper-drying cylinder of a yankee-dryer.

Other features, properties and advantages of the invention will become apparent from the following description and the practical examples included therein.

It is to be generally noted that the layers obtained with the powders according to the invention, have a lamellar structure, in which juxtaposed lamellae are formed of different alloys which impart to the lamellae a different hardness and/or a different static coefficient of friction. As a result, the layer exhibits very good frictional properties and a uniform degree of wear. More especially, the properties of the layer may, by choice of the alloy powders and the mixing ratio, be very accurately matched to a specific case of use, i.e. to desired mechanical properties, such as coefficient of friction and wear resistance, and to required physical properties of the layer, such as elasticity, weak internal tensions, etc. It is also possible thereby to satisfy in best possible manner the generally contradictory requirements as regards high resistance to wear and good frictional properties.

The spraying powders which are advantageously used may have the usual grain size. They can be applied by a conventional thermal spraying process, such as, for example, with an oxyacetylene powder flame-spraying torch, an arc spray gun or a plasma spray gun. More especially, in the event of iron alloys being used, the layer may also be produced with a wire-spraying pistol. Depending on the method being used, the lamellae will be in a coarser or finer form. The layer is always produced by spraying, without subsequent fusion, the substrate being provided with a conventional bond coat.

By the possibility of keeping the inherent tensions of the layers low, the layers produced with the powders according to the invention may have a thickness up to 10 mm, whereas in conventional layers having a hardness of more than 400 Hv, micro-cracks due to internal stresses are practically unavoidable, already at a thickness of about 1.5 mm. Because of the mentioned structure, the layers produced by the powders according to the invention also withstand the temperature loadings which occur in operation of the substrate part.

The said properties are achieved, more especially, in the following examples.

EXAMPLE 1

A paper-drying cylinder of a yankee-dryer, having a diameter of 4.5 mm, and being subjected, at an operating temperature of about 250° C., to the frictional loading of the scraper blade, usually has to be removed and repaired after 3 or 4 months, for example, when a coating containing Mo-Cr is used thereon. By using a layer sprayed with the powders according to the invention, an increase in the effective life to 3 to 4 years is reached. The layer in this case has a thickness of 4 mm and is produced from the following alloy powders A and B, in a mixing ratio of A:B=60:40 percent by weight, by using an oxyacetylene torch. The composition of the alloys is indicated in all examples as a percentage by weight.

| Powder 1 Alloy A (Hv 450) | | Powder 2 Alloy B (Hv 400) | |
|---|---|---|---|
| Cr | 20.0 | Cr | 16.0 |
| Mo | 5.0 | C | 0.2 |
| W | 0.5 | Ni | 2.0 |
| Si | 1.0 | Fe | remainder |
| C | 1.5 | | |
| Ni | remainder | | |

EXAMPLE 2

A guide or deflector roller in an installation for the cold rolling of metal sheets and having a diameter of 160 mm is provided, by the use of an oxyacetylene torch, with a 3 mm thick layer of the following alloy powders A and B, used in a mixing ratio A:B=70:30. The effective life of the roller is in this case increased tenfold. It appeared from a probe that martensite is being formed during the spraying.

| Powder 1 Alloy A (Hv 350) | | Powder 2 Alloy B (Hv 280) | |
|---|---|---|---|
| W | 5.0 | Ni | 4.0 |
| Cr | 28.0 | Cr | 11.0 |
| Mo | 2.0 | Si | 0.5 |
| Si | 1.0 | Fe | remainder |
| C | 1.0 | | |
| Co | remainder | | |

EXAMPLE 3

A shaft with a diameter of 300 mm. and rotating in a plain bearing is provided by means of a plasma torch with a layer in a thickness of 2 mm. of the following alloy powders A and B, with a mixing ratio of A:B=80:20 and, as a result the effective life is increased tenfold as compared with a conventional steel shaft.

| Alloy A (Hv 420, $H_S$ 0.08) | | Alloy B (Hv 250, $H_S$ 0.15) | |
|---|---|---|---|
| Ni | 2.0 | Cr | 20 |
| Cr | 27.0 | Ni | remainder |
| W | 8.0 | | |
| Si | 0.5 | | |
| C | 1.5 | | |
| Co | remainder | | |

EXAMPLE 4

The sliding surface of a fast-running slide which is under low compressive stress is provided with a layer of the following alloy powders A and B, with the mixing ratio A:B=70:30, and thereby an excellent resistance to frictional wear is produced.

| Alloy A (Hv 250, $H_S$ 0.11) | | Alloy B (Hv 160, $H_S$ 0.06) | |
|---|---|---|---|
| Ni | 36 | Cr | 5 |
| Fe | remainder | Ni | remainder |

Whereas the best possible hardness range in most cases of application is between 200 and 500 Hv, it is also possible, in accordance with the invention, to use alloys up to 650 Hv. The minimum difference in hardness is preferably 30 Hv and the minimum difference of the static coefficient of friction 0.02 $\mu s$. Furthermore, the alloy powders are advantageously free from boron, as a result of which, firstly, the danger of a formation of hard phases is eliminated and, secondly a formation of oxide between adjacent lamellae is avoided, which could, under pressure loading, lead to a slipping of the lamellae one upon the other. In all cases and more particularly when using iron-based alloy powders as less hard component, it is expedient to employ alloys which experience a change in structure during the spraying operation. Such a change in structure is advantageously one which results in a increase in volume. With iron based alloys more particularly the change in structure can be a martensitic modification or conversion, which has proved to be particularly advantageous for avoiding inherent tensions. Moreover, particularly good results are obtained with alloys of Ni, Cr, Mo, Si and C as one of the alloys of the mixture, and alloys of Fe, Cr and C as another alloy thereof. The Ni-Cr-Mo-Si-C alloys comprise advantageously an addition of tungsten and the Fe-Cr-C alloys an addition of nickel. Also alloys of Co, Cr, W, Si and C are advantageously used together with alloys of Fe, Cr and C, at least one of these alloys of the mixture having preferably an addition of nickel. Alternatively Ni, Cr, W, Si and C alloys are used with Fe, Cr, C alloys, the latter having preferably an addition of nickel.

The mixing ratio between the two different alloy powders is generally between 90:10 and 10:90, ratios from 70:30 to 30:70 percent by weight having been found to be the preferred range.

We claim:

1. A spraying powder for producing, by thermal spraying on a substrate, a heterogenous layer characterized by a lamellar structure comprising juxtaposed lamellae formed from at least two different alloy powders, said spraying powder comprising a mechanical mixture of said at least two different alloy powders, said at least two different alloy powders being selected from the group consisting of a boron-free nickel and/or a cobalt and/or an iron-base alloy, wherein the hardness of each of said alloys is compared in similar as-cast form, or a similar sprayed-on coating form, and wherein each has a different hardness ranging from 200 to 650 Hv and a different static coefficient of friction in the range from 0.01 to 0.3 $\mu_S$, said hardness difference between the selected alloys being at least 30 Hv.

2. The spray powder mixture according to claim 1, wherein at least one of the alloys of said mixture is selected from alloys which undergo a modification in structure during the spraying operation.

3. The spray powder mixture according to claim 1, wherein the hardness range of each of the alloys is between 200 and 500 Hv.

4. The spray powder mixture according to claim 1, wherein the difference in the static coefficient of friction is at least 0.02 $\mu_S$.

5. The spray powder mixture according to claim 1, wherein a first alloy powder in the mixture is based on a nickel-base and/or a cobalt-base alloy powder, having a hardness in the as-cast or sprayed-coating form in the vicinity of the upper limit of the hardness range of the product produced from the entire spray powder mixture, and wherein a second alloy powder in the mixture is based on iron, the product of which has a hardness in the vicinity of the lower limit of said hardness range.

6. The spray powder mixture according to claim 5, wherein the iron-based alloy powder is selected to undergo a modification in structure during the spraying operation to form a coating.

7. The spray powder mixture according to claim 6, wherein said structural modification produces an increase in volume of the sprayed coating.

8. The spray powder mixture according to claim 6, wherein said structural modification is a martensitic structure.

9. The spray powder mixture according to claim 5, wherein a first alloy powder is an alloy of substantially Ni, Cr, Mo, Si, and C, and wherein a second alloy powder is an alloy of substantially Fe, Cr, and C.

10. The spray powder mixture according to claim 9, wherein the Ni-Cr-Mo-Si-C alloy powder also contains tungsten.

11. The spray powder mixture according to claim 9, wherein the Fe-Cr-C alloy powder also contains nickel.

12. The spray powder mixture according to claim 5, wherein a first alloy powder is an alloy of substantially Co, Cr, W, Si, and C, and wherein a second alloy powder is an alloy of substantially Fe, Cr, and C.

13. The spray powder mixture according to claim 12, wherein at least one of the two powders also contains nickel.

14. The spray powder mixture according to claim 5, wherein a first alloy powder is an alloy of substantially Ni, Cr, W, Si, and C, and wherein a second alloy powder is an alloy of substantially Fe, Cr, and C.

15. The spray powder mixture according to claim 14, wherein the Fe-Cr-C powder also contains nickel.

16. The spray powder mixture according to claim 1, comprising a first alloy powder of substantially Co, Cr, Mo, Si, and C, which in the form of a metal product has a hardness in the vicinity of the upper limit of the hardness range of the product produced from the entire spray powder mixture, and a second alloy powder of substantially Ni and Cr, which in the form of a metal product has a hardness in the vicinity of the lower limit of said hardness range.

17. The spray powder mixture according to claim 16, wherein the Co-Cr-Mo-Si-C alloy powder also contains nickel.

18. The spray powder mixture according to claim 16, wherein the Ni-Cr alloy powder also contains iron.

19. The spray powder mixture according to claim 1, wherein the ratio of the two alloy powders in the mixture is between 90:10 and 10:90.

20. A spraying powder for producing, by thermal spraying on a substrate, a heterogeneous layer characterized by a lamellar structure comprising juxtaposed lamellae formed from at least two different alloy powders, said spraying powder comprising a mechanical mixture of said at least two different alloy powders, said at least two different alloy powders being selected from the group consisting of a boron-free nickel and/or a cobalt and/or an iron-base alloy, the hardness of a first alloy in an as-cast form, or a sprayed-on coating form, of the said alloy powder mixture being within the range of 200 to 450 Hv, and the hardness of a second alloy in similar as-cast form, or a similar sprayed-on coating form, of the said alloy powder mixture being within the range of 350 to 650 Hv, the difference in hardness between the said first and second alloys being at least 30 Hv, and at least one of said first and second alloys being selected from alloys which undergo a modification in structure during the spraying operation.

21. The spray powder mixture according to claim 20, wherein one of the alloy powders is an iron-base alloy powder and is selected so that it undergoes said modification in structure during the spraying operation.

22. The spray powder mixture according to claim 21, wherein said structural modification produces an increase in volume.

23. The spray powder mixture according to claim 21, wherein said structural modification is a martensitic structure.

24. The spray powder mixture according to claim 20, wherein said first alloy comprises Fe, Cr, and C, and said second alloy comprises Ni, Cr, Mo, Si, and C.

25. The spray powder mixture according to claim 24, wherein said second alloy also contains tungsten.

26. The spray powder mixture according to claim 24, wherein said first alloy also contains nickel.

27. The spray powder mixture according to claim 20, wherein said first alloy comprises Fe, Cr, and C, and said second alloy comprises Co, Cr, W, Si, and C.

28. The spray powder mixture according to claim 27, wherein at least one of the two alloys also contains nickel.

29. The spray powder mixture according to claim 20, wherein said first alloy comprises Fe, Cr, and C, and said second alloy comprises Ni, Cr, W, Si, and C.

30. The spray powder mixture according to claim 29, wherein the Fe-Cr-C alloy also contains nickel.

31. The spray powder mixture according to claim 20, wherein said first alloy comprises Ni and Cr, and said second alloy comprises Co, Cr, Mo, Si, and C.

32. The spray powder mixture according to claim 31, wherein said Co-Cr-Mo-Si-C alloy also contains nickel.

33. The spray powder mixture according to claim 31, wherein said Ni-Cr alloy also contains iron.

34. The spray powder mixture according to claim 20, wherein the ratio of the two alloy powders is between 90:10 and 10:90.

35. The spray powder mixture according to claim 1, wherein the ratio of the two powders is 70:30 to 30:70.

36. The spray powder mixture according to claim 20, wherein the ratio of the two alloy powders is between 70:30 to 30:70.

* * * * *